US006180198B1

(12) United States Patent
Bond

(10) Patent No.: US 6,180,198 B1
(45) Date of Patent: Jan. 30, 2001

(54) MULTI-PART SETS OF SHEET MATERIAL

(75) Inventor: Michael Peter Bond, Nr Rugby (GB)

(73) Assignee: Carrs Paper Limited, West Midlands (GB)

( * ) Notice: Under 35 U.S.C. 154(b), the term of this patent shall be extended for 0 days.

(21) Appl. No.: 09/008,795

(22) Filed: Jan. 20, 1998

(30) Foreign Application Priority Data

Sep. 10, 1997 (GB) ..... 9719133

(51) Int. Cl.[7] ..... B65D 65/28

(52) U.S. Cl. ..... 428/43; 428/40.1; 428/40.2; 428/41.6; 428/42.1; 428/121.192; 462/8; 462/24; 462/25; 503/227

(58) Field of Search ..... 428/40.1, 40.2, 428/41.6, 42.1, 43, 121, 192; 462/8, 24, 25; 503/227

(56) References Cited

U.S. PATENT DOCUMENTS 5,224,897 * 7/1993 Linden ..... 462/24
5,393,265 * 2/1995 Linden ..... 462/24
5,755,375 5/1998 Rogers ..... 229/70

FOREIGN PATENT DOCUMENTS 1010144 12/1986 (BE) .
27 30 073 12/1978 (DE) .
30 38 687 5/1982 (DE) .
WO 97/35729 10/1997 (EP) .

* cited by examiner

*Primary Examiner*—Nasser Ahmad
(74) *Attorney, Agent, or Firm*—Arthur L. Plevy; Buchanan Ingersoll PC

(57) ABSTRACT

A multi-part set providing for so-called "carbonless" copying between parts of the set, comprises a piece of sheet material such as paper with respective portions of at least one face of the sheet being treated to provide for imaging therebetween when such portions lie in face to face relationship, the piece of material being folded to bring the treated portions into face to face relationship and being provided with at least one separation line. Two-part, three-part and four-part sets are disclosed.

11 Claims, 4 Drawing Sheets

FIG 2a
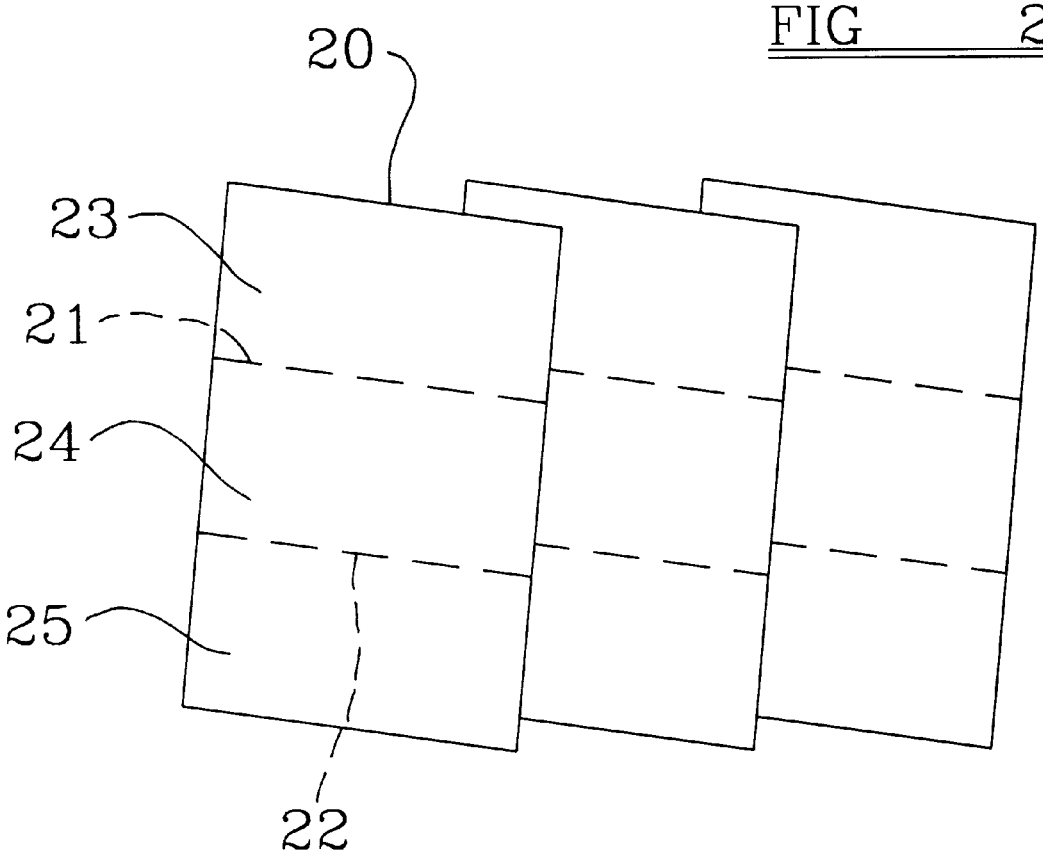
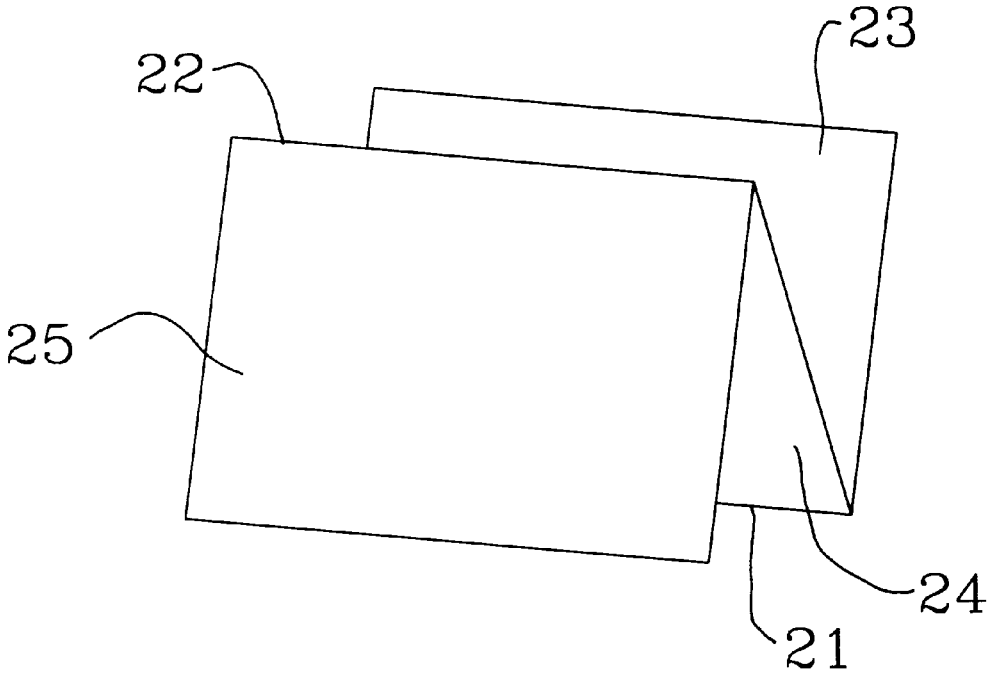
FIG 2b

FIG 3a
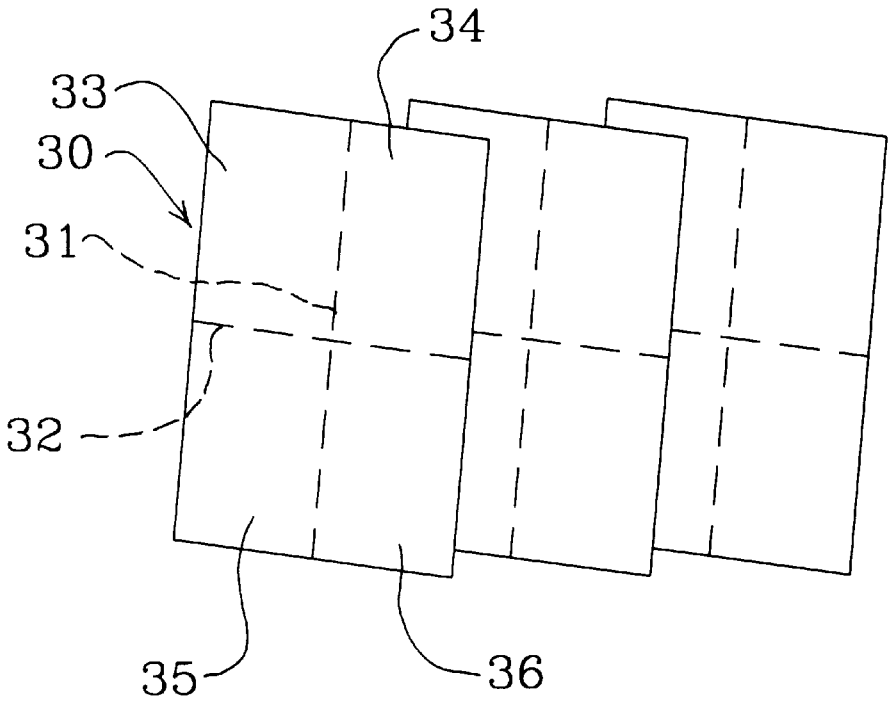
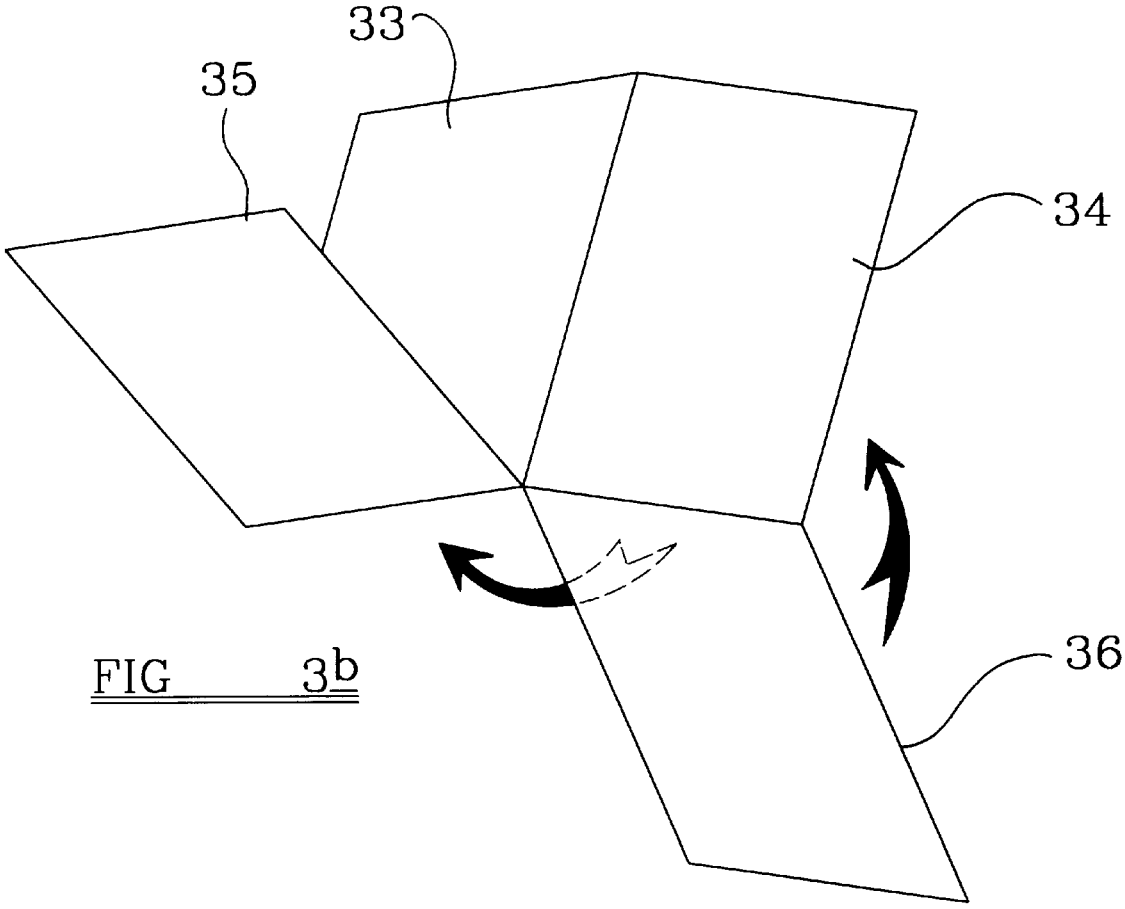
FIG 3b

FIG 4a
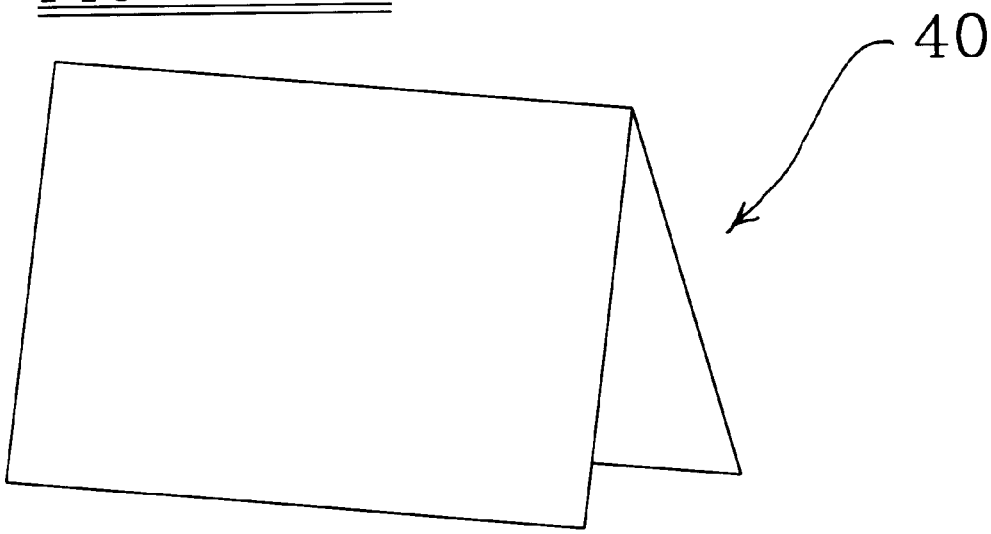
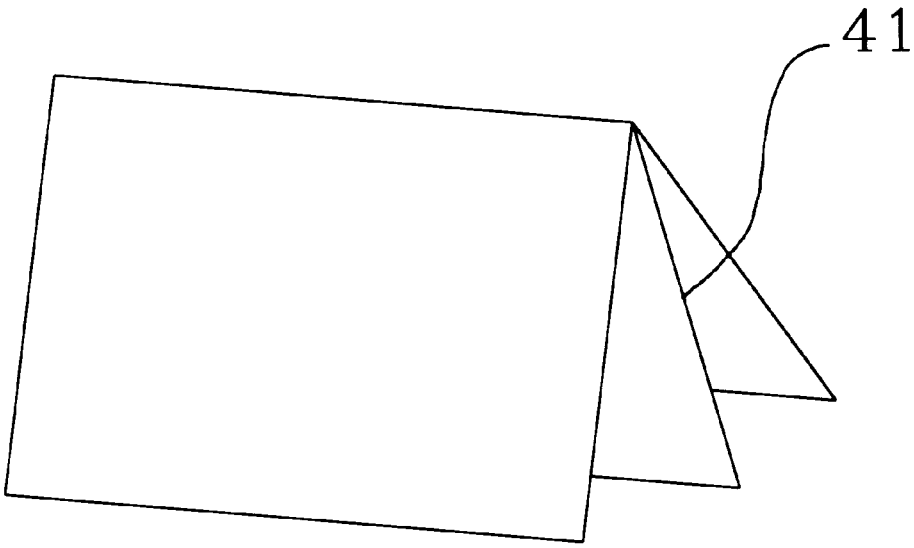
FIG 4b

MULTI-PART SETS OF SHEET MATERIAL

BACKGROUND TO THE INVENTION

1. Field of the Invention

This invention relates to multi (i.e. two or more) part sets of sheet material, which when a set is used provide for so-called "carbonless" copying or imaging between parts of the set, whereby impact printing of an image on an upper sheet of the set will simultaneously make similar images on a or the lower sheet or sheets of the set, and wherein at least some of the sheets of a set may bear a pre-applied image.

The sheet material usually is paper and herein will generally be referred to as such; however it is to be understood that the invention is applicable to the use of other suitable sheet material.

2. Description of Prior Art

Multi-part sets of so-called "carbonless" papers are well known. They rely on two coatings formed respectively on the contiguous faces of superimposed sheets. The coatings usually are one containing a colour-forming substance, usually contained in micro-capsules, on the back (underside) of an upper sheet (usually known as a CB coating) and a coating of a receptor layer on the front (upper side) of a lower sheet (usually known as a CF coating). Colour-forming chemicals are typically dissolved in an oily solvent and encapsulated by well known techniques, and when micro-capsules thus produced are ruptured by mechanical pressure, as by impact in a printing process involving mechanical impact, the chemicals are released and react to form a visible mark on the CF coating of the adjacent sheet. One or more sheets having a CB coating on the underside and a CF coating on the upper side (known as a CFB sheet) may be interposed between uppermost and lowermost sheets having CB and CF coatings respectively on their underside and upper side as aforesaid. An image may be pre-applied to the upper side of each sheet by a suitable printing process (e.g. offset, ink jet or toner deposition) which does not damage the coating on the sheets.

Most commonly, such multi-part sets have been made by preparing the sheets individually and then securing them together in sets by the use of adhesive. The collating of individual sheets to form sets and use of adhesive to secure them together in the sets is time consuming and expensive. It can require special coatings to ensure the adhesive will only adhere the sets together. The operation requires skill and experience, and results are not always reliable. Any problem arising at this stage might entail the wastage of material which has already been subjected to relatively costly treatment, if the problem cannot be rectified.

SUMMARY OF THE INVENTION

It is broadly an object of the present invention to provide for the cost-effective manufacture of multi-part sets without the need for adhesives.

According to one aspect of the present invention, we provide a method of making a multi-part set of sheet material, comprising treating respective portions of at least one face of a piece of the sheet material to provide for imaging therebetween when said portions of the sheet are in contiguous face-to-face relationship; pre-applying an image to a portion or portions of the sheet; providing at least one separation line between respective portions of the sheet; and providing at least one fold between portions of the sheet to bring said treated portions thereof into said contiguous face-to-face relationship.

The treatment of the portions of the piece of sheet material, preferably comprises, as is conventional for "carbonless" imaging, the application of a colour-forming (CB) coating and a receptor (CF) coating thereto. Preferably the sheet material is paper.

The colour-forming (CB) coating preferably consists of micro-encapsulated colour-forming material, and the receptor (CF) coating is conveniently a suitable reactive clay coating but could consist of other receptor coatings (e.g. phenolic CF zinc salicylate or other suitable substance.

By providing a separation line, we mean that the sheet material is treated such that the portions between which the separation line is provided are easily folded and readily separated from one another. Usually this will comprise partially severing the portions from one another, e.g. by a discontinuous cut line or a line of perforations.

In a simplest embodiment of the invention, the multi-part set may be a two part set, and said colour-forming and receptor coatings may be provided on respective portions of the same face of the sheet, with the separation line between said portions. Folding of the sheet may be effected at or adjacent said separation line to bring said coated portions into contiguous face-to-face relationship. The pre-applied image may be provided on the portion of the sheet having the receptor coating and the opposite surface of the portion of the sheet having the colour-forming coating.

In a further embodiment of the invention, a three-part set may be provided. A sheet may be provided with two separation lines extending substantially parallel to one another and spaced so that the sheet comprises three equally or generally equally sized portions. Two adjacent such portions of one surface of the sheet may be provided with colour-forming (CB) and receptor (CF) coatings, whilst two portions of the other face of the sheet also are respectively provided with CB and CF coatings, the common portion having a CB coating on one face and a CF coating on its other face (i.e. constituting a CFB portion). A sheet thus prepared, and which may be provided with a preapplied image on its portions as required, can then be folded in zig-zag fashion to provide a three-part set.

In yet a further embodiment of the invention, a four-part set may be provided. A piece of sheet material may be provided with two separation lines extending substantially perpendicular to one another so as to divide the piece of material into four portions equal or generally equal in size to one another. Two of said portions to one another may be provided with colour forming and receptor coatings on their respective opposite sides so that they are CFB portions. One of the other two portions may be provided on one face with a colour-forming coating and the remaining portion may be provided on one face with a receptor coating. Then by appropriate cutting and folding of the piece of sheet material a four-part set may be created in which the portions provided with the colour-forming coating and the receptor coating respectively constitute the uppermost and lowermost sheets of the set, while the CFB portions constitute intermediate sheets of the set. A required image or images may have been printed on the portions as required prior to the folding thereof to form the set.

The invention also provides a multi-part set resulting from the carrying out of the method.

The invention yet further provides sheet material for use in carrying out the method of the invention, comprising portions treated to provide for said "carbonless" imaging therebetween and at least one separation line between respective portions of the sheet.

The treated portions are preferably provided with CF and/or CB coatings in any of the arrangements above described.

It is envisaged that sheets of material prepared as above described will be supplied to printers who will print, e.g. forms, in accordance with their customers' requirements on the sheets and then fold them to form the multi-part sets to be supplied to their customers for use. Such printing may be, for example, offset printing or an electronic printing process.

In carrying out the invention, as will be appreciated from the following description of specific embodiments thereof, the pre-applied image on the portions of the piece of sheet material may require to be printed on both faces thereof. Whilst such printing involves higher costs than printing on one face only of a sheet of material, it is believed that multi-part sets in accordance with the invention can still be produced more economically than by methods proposed hitherto.

BRIEF DESCRIPTION OF DRAWINGS

The invention will now be described by way of example with reference to the accompanying drawings, of which:

FIGS. 2A and 2B illustrate the manufacture of a three-part set in accordance with the second embodiment of the invention;

FIGS. 3A and 3B illustrate the manufacture of a four-part set in accordance with a third embodiment of the invention;

FIGS. 4A and 4B illustrate further embodiments of the invention.

DESCRIPTION OF PREFERRED EMBODIMENTS

Figure 1A:
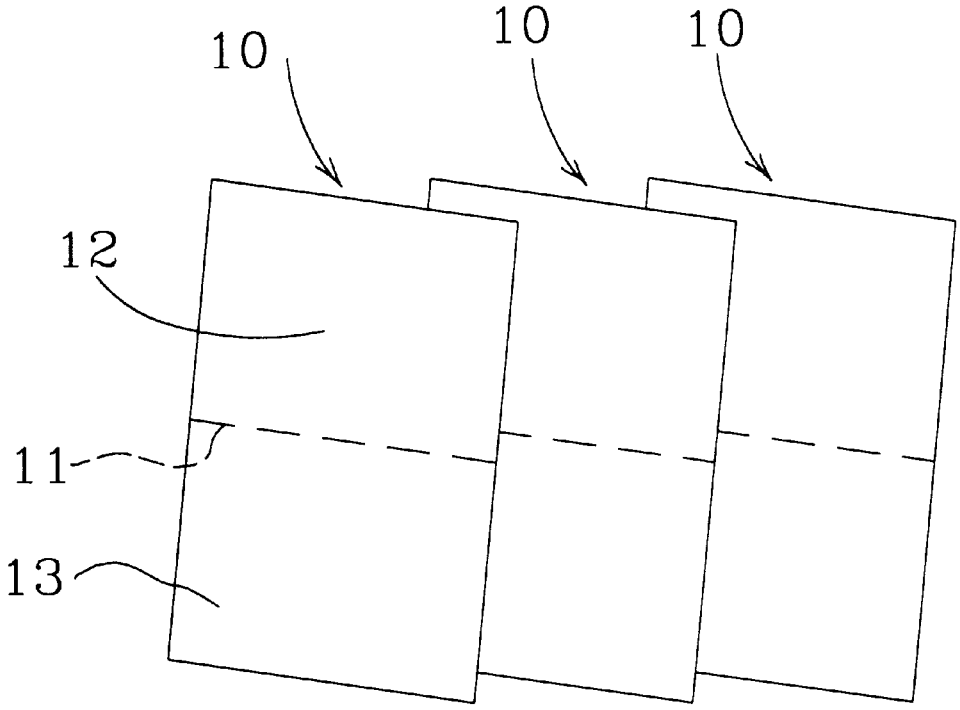
FIGS. 1A and 1B illustrate the manufacture of a two-part set in accordance with the first embodiment of the invention.
Figure 1B:
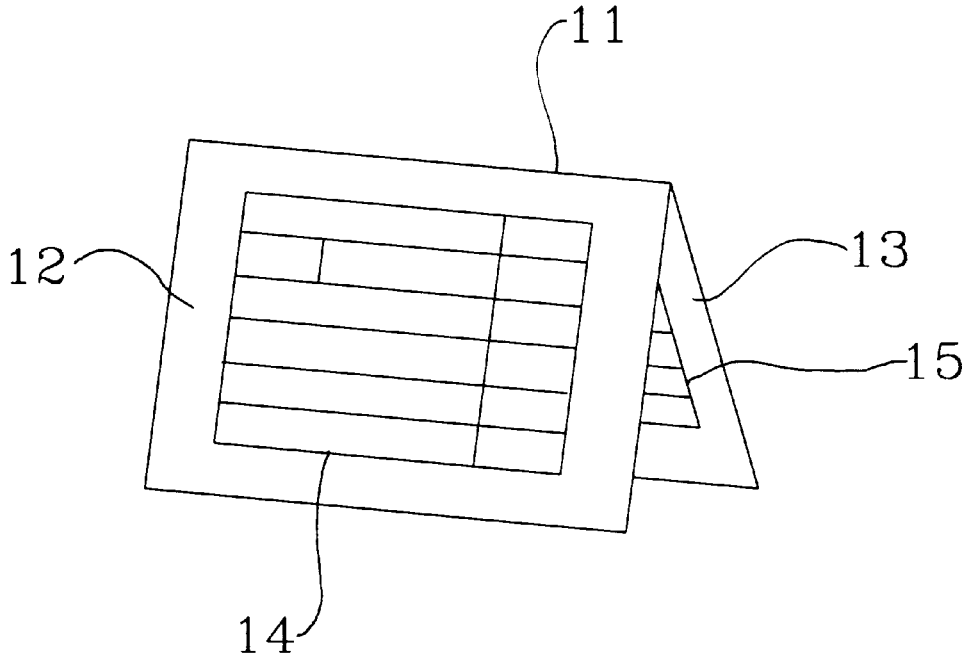

Referring firstly to FIGS. 1A and 1B of the drawings, these illustrate the manufacture in accordance with the invention of a two-part set. FIG. 1A shows a succession of generally rectangular pieces 10 of sheet material which preferably is paper and such a sheet is divided by a separation line 11 extending transversely across it, into two portions 12, 13. Separation line 11 is conveniently a line of small perforations, facilitating the separation of the portions 12, 13 from one another. The visible surface of the sheet is patch coated in the portion 12 with a colour-forming (CB) coating, e.g. with colour-forming chemicals micro-encapsulated therein, and in the portion 13 with a receptor (CF) coating, e.g. a suitable receptor clay, while the under surface of the sheet need not be treated with any coating. The coatings may be tinted, as may be the non-coated parts of the sheet. The sheet may be pre-printed before being coated.

An image as required is applied to the sheet while it is still flat. A form may be printed on the surface of the portion 12 which is opposite the portion with the CB coating, and the same or a different form may be printed on the CF coated surface of the portion 13 of the sheet. Thereafter the two-part set is created by folding the sheet along the separation line 11 or near thereto, as indicated in FIG. 1B. In this figure, a printed form is indicated at 14 on the surface which is now visible of the portion 12, while the CB coated and now invisible surface of the portion 12 lies in contiguous face-to-face relationship with the CF coated surface of the portion 13. A form printed on such surface is shown at 15.

It will be appreciated that if the form 15 is required on the portion 13, the printing process of the forms 14 and 15 will be a duplex process, i.e. printing is carried out on both surfaces of the sheet 10.

Referring now to FIG. 2 of the drawings, FIG. 2A shows a sheet 20 divided by two separation lines 21, 22 into three portions 23, 24, 25. The visible (upper) surface of the portion 23 is provided with a CF coating and such surface of the portion 24 with a CB coating. The non-visible under surface of the portion 25 is provided with a CB coating and such surface of the portion 24 with a CF coating, so that the portion 24 is a CFB portion.

When such a sheet is folded in zig-zag fashion at the separation lines 21, 22 a three-part set is created as shown in FIG. 2B with the portion 25 forming the first or uppermost sheet of the set, the portion 24 an intermediate sheet, and the portion 23 the lowermost sheet of the set. Prior to such folding, the uncoated surface of the portion 25 and the CF coated surface of portions 23, 24 would be printed with a required image or images.

Referring now to FIG. 3 of the drawings, this shows a sheet 30 which is provided with two separation lines 31, 32 extending perpendicularly to one another, to divide the sheet into four substantially equally sized portions 33, 34, 35, 36. The portion 33 is patch coated on its visible upper surface with a CF coating and on its under surface with a CB coating. The portion 34 is provided on its visible surface with a CB coating and on its under surface with a CF coating. The portions 35, 36 are provided on their visible surfaces with a CB and a CF coating, respectively, whilst their under surfaces are uncoated.

After printing with an image such as a form on the required surfaces, the sheet is cut along the separation line 31 between the portions 35, 36, and then folded as shown in FIG. 3B. The portions 35, 36 are folded to overlie the portions 33, 34, while the portions 34, 36 together are then folded under the superimposed portions 35, 33 to lie therebeneath. Thus a four-part set is formed in which the portion 35 is the first or uppermost sheet, the portions 33, 34 are intermediate sheets, and the portion 36 is the final or lowermost sheet of the set.

Thus the invention enables multi-part sets to be created in a manner which does not involve the collating and adhesively securing of individual sheets as has generally been the case hitherto.

Nevertheless "hybrid" multi-part sets may be made as shown in FIG. 4. FIG. 4A of the drawings illustrates a two-part set 40 as shown in FIG. 1B. As shown in FIG. 4B, an intermediate CFB sheet 41 may be inserted between the portions of the two-part set 40, to create a three-part set.

The features disclosed in the foregoing description, or the following claims, or the accompanying drawings, expressed in their specific forms or in terms of a means for performing the disclosed function, or a method or process for attaining the disclosed result, as appropriate, may, separately or in any combination of such features, be utilised for realising the invention in diverse forms thereof.

What is claimed is:

1. A method of making a three-part set of sheet material, the method comprising the steps of:

providing a sheet of sheet material having at least one fold line and spaced separation lines extending generally parallel to one another, the separation lines dividing the sheet into three portions, each of the portions having opposing first and second faces;

treating the first faces of two adjacent ones of the portions of the sheet with image formers to provide imaging therebetween when the treated first faces are contiguous with each other;

treating the second faces of two adjacent ones of the portions of the sheet with image formers to provide imaging therebetween when the treated second faces are contiguous with each other, wherein the first and second faces of one of the portions are both treated; and folding the sheet along the at least one fold line in a zig-zag manner to form a three part set of sheet material.

2. A method of making a four-part set of sheet material, the method comprising the steps of:

providing a sheet of sheet material having at least one fold line and two separation lines extending substantially perpendicular to one another, the separation lines dividing the sheet into four portions;

treating respective faces of two adjacent ones of the portions of the sheet with image formers to provide imaging therebetween and to provide imaging with other ones of the portions treated with image formers when disposed in face-to-face relationship therewith;

treating faces of the other portions of the sheet with image formers to provide imaging with the two adjacent treated portions; and severing the sheet and folding the sheet along the at least one fold line to provide a four part set wherein the two adjacent treated portions constitute intermediate sheets of the set and the other portions constitute uppermost and lowermost sheets of the set.

3. A three-part set comprising:

a sheet of sheet material having two folds and two spaced apart means providing separation lines extending generally parallel to one another, the lines dividing the sheet into three portions, each of the portions having opposing first and second faces;

two adjacent ones of the portions of the sheet having first faces treated with image formers to provide imaging therebetween;

two adjacent ones of the portions of the sheet having second faces treated with image formers to provide imaging therebetween;

wherein the sheet is folded along the two folds in a zig-zag manner with the treated first faces being contiguous with each other and the treated second faces being contiguous with each other.

4. A four-part set comprising:

a sheet of sheet material having at least one fold and two means providing separation lines extending substantially perpendicular to one another, the lines dividing the sheet into four portions;

two adjacent ones of the portions having both faces thereof treated with image formers to provide imaging therebetween; and other portions of the sheet having one face each treated with image formers;

wherein the sheet is cut and folded along the at least one fold and the two adjacent treated portions form intermediate sheets of the set and the other portions form uppermost and lowermost sheets of the set.

5. A piece of sheet material for use in making a multi-part set, said piece comprising at least two portions respectively treated on at least one face to provide for imaging therebetween when said portions lie in contiguous face to face relationship; and means providing two separation lines between portions of the piece, the lines extending substantially perpendicular to one another.

6. A method according to claim 1 comprising pre-applying an image to at least one portion of the piece of sheet material.

7. A method according to claim 1 wherein said provision of a separation line between portions of the piece of sheet material comprises partially severing said portion from one another.

8. A method according to claim 8 wherein said treatment of portions provide for imaging therebetween comprises the application of a colour-forming coating to one surface portion and of a receptor portion to another surface portion, and wherein said common portion has a colour-forming coating on one face and a receptor coating on its other face.

9. A multi-part set according to claim 3 wherein said sheet material is paper.

10. A multi-part set according to claim 3 wherein said treatment comprises a colour-forming coating and a receptor coating respectively on said portions.

11. A multi-part set according to claim 3 comprising a pre-applied image on at least one of said portions of the piece of sheet material.

* * * * *